US012768230B2

(12) United States Patent
Bruandet

(10) Patent No.: US 12,768,230 B2
(45) Date of Patent: Oct. 20, 2026

(54) FULLY SEALED DOWN THE HOLE HAMMER

(71) Applicant: SANDVIK MINING AND CONSTRUCTION OY, Tampere (FI)

(72) Inventor: Olivier Bruandet, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 19/131,257

(22) PCT Filed: Nov. 16, 2023

(86) PCT No.: PCT/EP2023/082057
§ 371 (c)(1),
(2) Date: May 20, 2025

(87) PCT Pub. No.: WO2024/110307
PCT Pub. Date: May 30, 2024

(65) Prior Publication Data

US 2026/0201760 A1 Jul. 16, 2026

(30) Foreign Application Priority Data

Nov. 21, 2022 (EP) ..... 22208586

(51) Int. Cl.
*E21B 10/38* (2006.01)
*E21B 10/60* (2006.01)
*E21B 21/00* (2006.01)

(52) U.S. Cl.
CPC ..... *E21B 21/00* (2013.01); *E21B 10/602* (2013.01)

(58) Field of Classification Search
CPC . E21B 4/14; E21B 4/145; E21B 10/38; E21B 10/36; E21B 1/26; E21B 1/30; E21B 1/32; E21B 1/28; E21B 4/06
See application file for complete search history.

(56) References Cited

U.S. PATENT DOCUMENTS 3,429,390 A 2/1969 Bennett
3,595,323 A * 7/1971 Schindler ..... E21B 4/14 173/132
3,735,820 A * 5/1973 Curington ..... E21B 4/14 173/78

(Continued)

FOREIGN PATENT DOCUMENTS

CN 112796673 A 5/2021
DE 2645693 A1 4/1978

(Continued)

*Primary Examiner* — Kipp C Wallace
(74) *Attorney, Agent, or Firm* — Corinne R. Gorski

(57) ABSTRACT

A down the hole drilling assembly includes a drill bit, a shank, a driver sub, a flushing passage sub, at least one flushing channel, and a sealing element arranged in the flushing passage extending radially from the outer surface of the shank to the inner surface of the driver sub. The flushing passage and the at least one flushing channel are configured to allow a flow of fluid from the flushing passage to the at least one flushing channel in a flow direction of the fluid. The sealing element is positioned above an inlet port of the at least one flushing channel along the flow direction and wherein the sealing element is configured to prevent a flow of fluid in a direction opposite to the flow direction.

14 Claims, 4 Drawing Sheets

(56) References Cited

U.S. PATENT DOCUMENTS

| | | | | | |
|---|---|---|---|---|---|
| 3,804,181 | A * | 4/1974 | Curington | E21B 4/14 | 464/162 |
| 3,944,003 | A * | 3/1976 | Curington | E21B 4/14 | 173/66 |
| 3,991,834 | A * | 11/1976 | Curington | E21B 21/12 | 175/215 |
| 4,079,793 | A * | 3/1978 | Mosely | E21B 4/14 | 173/132 |
| 4,094,364 | A | 6/1978 | Lundstrom et al. | | |
| 4,098,352 | A * | 7/1978 | Kita | E21B 4/14 | 173/78 |
| 4,790,390 | A * | 12/1988 | Sweeny | B23Q 1/0036 | 173/17 |
| 6,035,953 | A * | 3/2000 | Rear | E21B 10/38 | 175/320 |
| 7,921,941 | B2 * | 4/2011 | Aros | E21B 4/14 | 175/212 |
| 2007/0114067 | A1 | 5/2007 | Hall | | |
| 2008/0029312 | A1 | 2/2008 | Hall et al. | | |
| 2011/0253456 | A1 * | 10/2011 | Conn | E21B 10/38 | 175/418 |
| 2012/0186878 | A1 * | 7/2012 | Eddison | E21B 4/14 | 175/57 |
| 2016/0069134 | A1 * | 3/2016 | Carlsson | E21B 10/38 | 175/57 |
| 2019/0345772 | A1 * | 11/2019 | Bruandet | E21B 34/06 | |
| 2021/0062586 | A1 * | 3/2021 | Keskiniva | E21B 7/20 | |

FOREIGN PATENT DOCUMENTS

| | | | |
|---|---|---|---|
| EP | 019719 | A1 | 10/1986 |
| WO | 2013096365 | A2 | 6/2013 |

* cited by examiner

FULLY SEALED DOWN THE HOLE HAMMER

FIELD OF TECHNOLOGY

The present disclosure generally relates to a down the hole hammer drilling assembly. More specifically, the present disclosure relates to a sealing element for protecting a down the hole drilling assembly from hammer flooding during drilling.

BACKGROUND

Holes can be drilled in rock by means of various rock drilling assemblies. Drilling may be performed with a method of combining percussions and rotation. This type of drilling is called percussive drilling. Percussive drilling may be classified according to whether an impact device is outside the drill hole or in the drill hole during drilling. When the impact device is in the drill hole, the drilling is typically called down the hole (DTH) drilling. Since the impact device in the down the hole drilling assembly is located inside the drill hole, the structure of the impact device needs to be compact.

The technique of down the hole percussive hammer drilling involves the supply of a pressurized fluid via a drill string to a hammer located at the bottom of a drill hole. Generally, a percussive mechanism is provided in the hammer as a reciprocating piston, which is moved by controlling the feeding and discharging of pressurized fluid into and out of working chambers where the working surfaces of the piston are located. The percussive mechanism is configured to strike a drill bit being connected directly to a piston casing holding the percussive mechanism enabling the percussions to be transferred to the bottom of the drill hole enabling the hammer to cut forward in the drill hole. The fluid acts to both drive the hammer drilling action and to flush chips and fines resulting from the cutting action, rearwardly through the drill hole so as to optimize forward cutting. This pressurized fluid may therefore be understood as "flushing fluid", i.e. the pressurized fluid exiting the drilling assembly at its drilling end and having the effect of displacing the drilling cuts, chips, fines, residues, contaminants, etc. from the bottom of the drill hole towards the top of the drill hole via the space available between the inner wall of the drill hole and the outer surface of the drilling assembly positioned in the drill hole. The displacement of the drilling cuts, chips, fines, residues, contaminants, etc. from the drill hole towards the top of the drill hole by means of the flushing fluid may be understood as the "flushing action" of the down the hole drilling assembly.

During the flushing action of the down the hole drilling assembly, it is important that flushing fluid, comprising the flush chips and fines resulting from the cutting action, do not enter the drilling assembly which would lead to damages of its internal components. To this end, current solutions such as the implementation of valves in the down the hole drilling assembly have been generating a growing interest. Commonly, check valves located above the percussion mechanism in the drilling direction of the drilling assembly are used to create a closed volume inside the hammer preventing the flushing fluid from entering due to the residual pressure in the closed volume.

However, commonly used check valves fail to provide protection of the entire down the hole percussion mechanism against flushing fluid and said flushing fluid may still enter the percussion mechanism resulting in hammer flooding which increases the risk of internal damages, for example wear and oxidation. As used herein, "hammer flooding" may be understood as fluid, for example the flushing fluid, entering the drilling assembly from the drill hole and infiltrating the percussive hammer. Hammer flooding, or fluid infiltration of the percussive hammer, increases the risk of damage and contamination of the percussive mechanism, and of the drilling assembly as a whole. Internal damages due to hammer flooding may require the replacement of damaged components resulting in undesired and costly down time of the down the hole drilling assembly and in a reduction of its effective lifetime.

EP019719 discloses a drill bit comprising a stop ring. U.S. Pat. No. 4,094,364 discloses a percussive drill assembly comprising a sealing element positioned below the inlet port.

SUMMARY

It is therefore an object of the present disclosure to try to overcome at least some of the deficiencies of current check valve solutions for protecting the internal components of down the hole drilling assemblies against fluid and debris intrusion.

This and other objects are achieved by providing a down the hole drilling assembly comprising a sealing element and a drill bit for use in the down the hole drilling assembly having the features of the independent claims. Preferred embodiments are defined in the dependent claims.

Hence, according to a first aspect, there is provided a down the hole drilling assembly comprising a drill bit having an elongated shank and a drilling end. The down the hole drilling assembly further comprises a driver sub at least partially arranged around the drill bit and a flushing passage defined by an outer surface of the shank and an inner surface of the driver sub. Still further, the down the hole drilling assembly comprises at least one flushing channel formed in the drill bit, wherein the at least one flushing channel comprises an inlet port fluidly connecting the flushing passage and the at least one flushing channel, and an outlet port arranged at the drilling end. The down the hole drilling assembly according to the first aspect further comprises a sealing element arranged in the flushing passage and extending radially from the outer surface of the shank to the inner surface of the driver sub, wherein the flushing passage and the at least one flushing channel are configured to allow a flow of fluid from the flushing passage to the at least one flushing channel in a flow direction of the fluid, wherein the sealing element is positioned above the inlet port of the at least one flushing channel along the flow direction and wherein the sealing element is configured to prevent a flow of fluid in a direction opposite to the flow direction.

Thus, the present disclosure is based on the idea of improving the reliability of the down the hole drilling assembly by fully sealing the percussion mechanism such that it is protected from intrusion of fluid comprising flush chips and fines, therefore reducing the risk of damages and contamination. The down the hole drilling assembly of the present disclosure further stems from the idea of increasing the working life of the down the hole drilling assembly by positioning the sealing element proximate to the drilling end such that a greater number of internal components, including the percussive mechanism, may benefit from the sealing effect of the sealing element.

The drilling assembly of the present disclosure is therefore aimed at generating a sealed volume within the down the hole drilling assembly which alleviates, or at least greatly reduces, the risk of fluid entering the down the hole drilling assembly, for example due to operator mistakes and/or drill hole conditions, in turn reducing the risk of internal damages and excessive internal wear. The above-stated objects of the present disclosure are fulfilled at least by the provision of the sealing element having a unidirectional sealing function and by the positioning of the sealing element within the down the hole drilling assembly.

The down the hole drilling assembly of the present disclosure comprises components enabling the functionality of the sealing element particularly during the flushing action of the down the hole drilling assembly. Flushing is enabled by the flushing passage and the at least one flushing channel. That is, a flow of pressurized fluid, for example water and/or air, supplied to the drilling assembly is configured to flow through the flushing passage, through the at least one flushing channel and up the drill hole thereby remove drilling cuts and fines from the drill hole to improve the quality of the drilling. The flushing passage and the at least one flushing channel therefore form adjacently arranged portions of a continuous passageway for the flow of fluid to exit the down the hole drilling assembly at its drilling end, i.e. the end directly facing the bottom of the drill hole.

The flushing passage is defined by a volume formed between the drill bit and the driver sub at least partially arranged therearound. That is, the drill bit and the driver sub are arranged such that a space is created between the outer surface of the shank of the drill bit and the inner surface of the driver sub. Furthermore, the at least one flushing channel is comprised in the drill bit and enables a fluid communication between the flushing passage and the bottom of the drill hole. That is, the at least one flushing channel is configured to be formed through the drill bit, from its shank to its drilling end with the inlet port being arrange at the shank of the drill bit and the outlet port being arranged at the drilling end of the drill bit, facing the bottom of the bore hole. It will be appreciated that the down the hole drilling assembly of the present disclosure may additionally comprise a central bore formed through the drilling assembly in a concentric manner also enabling a path for flushing fluid. The flushing passage and the at least one flushing channel are therefore configured to allow a flow of fluid from the flushing passage to the at least one flushing channel in a flow direction of the fluid. The flow direction of the fluid may be understood as the same direction as the direction of drilling, i.e. downwards along the drilling assembly and towards the bottom of the drill hole.

The protection of the internal components of the down the hole drilling assembly, and therefore its reliability and its longevity, is increased by preventing any flow of fluid and contaminants from entering the drilling assembly in a direction opposite to the flow direction of the flushing fluid. The sealing element of the present disclosure fulfils this function by being arranged in the flushing passage and by its positioning along the shank of the drill bit. That is, the sealing element is configured to be positioned above the inlet port of the at least one flushing channel in the flow direction and extends radially from the outer surface of the shank of the drill bit to the inner surface of the driver sub. The sealing element therefore enables the division of the continuous passageway into two volumes, a first sealed volume positioned above the sealing element in the flow direction and comprising the flushing passage, and a second volume positioned below the sealing element in the flow direction and formed by the at least one flushing channel. The positioning of the sealing element above the inlet port of the at least one flushing channel further permits the maximization of the sealed volume. That is, the maximization of internal components of the drilling assembly being comprised in and/or protected from hammer flooding and from external contaminants by the sealed volume. Furthermore, the sealing element is configured to prevent a flow of fluid in a direction opposite to the flow direction. That is, the sealing element is configured to only allow flushing fluid to flow from the flushing passage into the at least one flushing channel, i.e. in the flow direction of the fluid, during the flushing action of the down the hole drilling assembly. The sealing element may therefore be understood as functioning as a unidirectional valve, or check valve, allowing a flow of fluid in one direction and preventing a flow of fluid in the opposite direction. The sealing element therefore allows the flushing action of the drilling assembly but prevents any back flow of fluid, drilling cuts, chips, fines, residues, contaminants from re-entering the sealed volume via the flushing channels once the pressure exerted by the flushing fluid at the bottom of the drill hole is relieved, i.e. when the flushing action is terminated. The combination of the sealing function and the flow restriction function of the sealing element therefore reduces the risk of internal component damages and excessive wear, in turn increasing the functional life of the drilling assembly and its reliability. Furthermore, it will be appreciated that the sealing element of the present disclosure may be implemented in combination with already existing check valve systems comprised in the down the hole drilling assembly.

According to some embodiments of the present disclosure, the sealing element may be fixedly attached to the shank of the drill bit by means of an interlocking structure. The fixed attachment of the sealing element to the shank of the drill bit enables the sealing element to remain positioned above the inlet port of the at least one flushing channel. The sealing element is further configured to be in contact with the inner surface of the driver sub, to which it extends radially from its fixed attachment to the shank of the drill bit, to provide a sealing effect to the volume of the flushing passage. It will be appreciated that the contact between the sealing element and the inner surface of the driver sub is interrupted during the flushing action of the drilling assembly to allow a flow of fluid to travel from the flushing passage to the at least one flushing channel.

According to some embodiments of the present disclosure, the interlocking structure may be a tongue and groove structure formed by an end of the sealing element configured to engage a groove comprised in the outer surface of the shank. It will be appreciated that alternative interlocking structures may be implemented to provide the fixed attachment of the end of the sealing element to the shank of the drill bit, for example a dovetail groove structure or a lap joint structure. The interlocking structure therefore provides an efficient and compact attachment of the sealing element to the shank of the drill bit. Other interlocking methods may also be used for fixing the end of the sealing element to the shank, for example by gluing the end of the sealing element to the shank, by using binding agents to fixate the sealing element to the shank, over casting, over molding, etc.

According to some embodiments of the present disclosure, the sealing element may be fixedly attached to the driver sub by means of an interlocking structure. Similarly as for a fixed attachment to the shank of the drill bit, the fixed attachment of the sealing element to the inner surface of the driver sub enables the sealing element to remain positioned above the inlet port of the at least one flushing channel. The sealing element is further configured to be in contact with the outer surface of the shank of the drill bit, to which it extends radially from its fixed attachment to the driver sub, to provide a sealing effect to the volume of the flushing passage. It will be appreciated that the contact between the sealing element and the outer surface of the shank of the drill bit is interrupted during the flushing action of the drilling assembly to allow a flow of fluid to travel from the flushing passage to the at least one flushing channel.

According to some embodiments of the present disclosure, the interlocking structure may be a tongue and groove structure formed by an end of the sealing element configured to engage a groove comprised in the inner surface of the driver sub. It will be appreciated that alternative interlocking structures may be implemented to provide the fixed attachment of the end of the sealing element to the driver sub, for example a dovetail groove structure or a lap joint structure. The interlocking structure therefore provides an efficient and compact attachment of the sealing element to the driver sub. Other interlocking methods may also be used for fixing the end of the sealing element to the driver sub, for example by gluing the end of the sealing element to the driver sub, by using binding agents to fixate the sealing element to the driver sub, over casting, over molding, etc.

According to some embodiments of the present disclosure, the sealing element may be formed of at least partially elastomer material. That is, the sealing element may be formed entirely of an elastomer material, such as, but not limited to: polyurethane, EPDM, PTFE, etc. or may be formed of a combination of elastomer material and other compounds, such as, but not limited to, an elastomer material combined with plastic, metal, POM, etc. The at least partially elastomer material provides elastic properties to the sealing element which enables it to bend under the 5 pressure exerted thereon by the flow of fluid during flushing, in turn allowing the flow of fluid to travel from the flushing passage to the at least one flushing channel. The at least partially elastomer material also provides the sealing element with the capacity of returning to its normal position, or sealing position, after having been bent under the pressure exerted thereon by the flow of fluid during flushing. That is, the material of the sealing element enables the sealing element to be folded by the 30 flushing fluid and to return to its unfolded form when the flushing action terminates.

According to some embodiments of the present disclosure, the down the hole drilling assembly may further comprise a piston casing configured to interconnect with the driver sub by means of corresponding threading comprised on an inner surface of the piston casing and on an outer surface of the driver sub. Further, the down the hole drilling assembly may comprise a sealing ring arranged between the inner surface of the piston casing and the outer surface of the driver sub, wherein the sealing ring is configured to prevent fluid, drilling cuts, chips, fines, residues, contaminants, etc. from entering the piston casing. The piston casing defines a housing comprising the percussion mechanism and shields the percussion mechanism from the walls of the drill hole whilst protecting it from debris and fluids flowing rearwardly through the drill hole. Furthermore, the driver sub enables the connection between the drill bit and the piston casing such that the percussion mechanism can impact, or strike, the drill bit enabling the drilling function of the down the hole drilling assembly. The sealing ring therefore protects the connection between the driver sub and the piston casing such that no external fluid or debris may enter the piston casing and damage or contaminate the percussion mechanism. It will be appreciated that the sealing ring may be positioned above or below the corresponding threading comprised on an inner surface of the piston casing and on an outer surface of the driver sub in the flow direction of the fluid, i.e. in the direction of drilling. It will further be appreciated that the sealing ring may be arranged between an end surface of the piston casing and an end surface of the driver sub, wherein the end surface of the piston casing and the end surface of the driver sub are configured to abut. For such configuration, the sealing ring also prevents fluid, drilling cuts, chips, fines, residues, contaminants, etc. from entering the piston casing.

According to some embodiments of the present disclosure, the drill bit may be configured to move axially relative to the driver sub between a drilling position and a flushing position. In the drilling position, the drill bit is positioned relative to the drive sub such that the reciprocating movement of the percussive mechanism may be transferred to the drill bit enabling the drilling end to cut forward into the drill hole. That is, in the drilling position, the position of the drill bit relative to the driver sub is such that the percussive mechanism may repeatedly impact, or strike, the working end of the drill bit, transferring the impact force to the drilling end of the drill bit. In the flushing position, the position of the drill bit relative to the driver sub is such that the repeated striking, or impacting, of the working end of the drill bit is stopped. In different words, in the flushing position, the position of the drill bit relative to the driver sub is such that the reciprocating motion of the percussive mechanism is stopped and therefore the striking motion of the drill bit towards the bottom of the drill hole is stopped. It will be appreciated that the flushing action of the down the hole drilling assembly may occur when the drill bit is in the flushing position and/or in the drilling position. It will further be appreciated that the sealing function of the sealing element is independent of the position of the drill bit and independent of flushing action of the drilling assembly. That is, the sealing element provides a sealing effect to the flushing passage regardless of the movement or position of the drill bit relative to the driver sub and regardless of whether the flushing passage is pressurized by the flushing action or not.

According to some embodiments of the present disclosure, the shank of the drill bit may comprise an end portion arranged adjacently to the drilling end wherein the outer surface of the shank along the end portion is configured to be in contact with the inner surface of the driver sub. Furthermore, the end portion of the shank may be configured to axially guide the drill bit relative to the driver sub during movement of the drill bit between the drilling position and the flushing position. The end portion of the shank therefore provides axial guidance to the drill bit along the longitudinal axis of the down the hole drilling assembly during its movement between the drilling position and the flushing position. It will be appreciated that the contact between the outer surface of the shank along its end portion and the inner surface of the driver sub is further configured to axially guide the drill bit during drilling, i.e. during percussive movement of the drill bit. The axial guiding of the drill bit is further advantageous in that it reduces the risks of damaging the sealing element extending radially between the outer surface of the shank and the inner surface of the driver sub by ensuring that the drill bit remains concentric with the driver sub during its movement. This in turn increases the efficiency of the sealing effect of the sealing element and increases its longevity.

According to some embodiments of the present disclosure, the driver sub may be provided with a plurality of driver sub splines arranged on its internal surface. Furthermore, the shank of the drill bit may be provided with a plurality of shank splines arranged on its outer surface. Still further, the shank splines may be configured to engage with the driver sub splines, moveably fixating the drill bit to the driver sub. The engagement between the shank spines and the driver sub splines is configured to transfer a rotational movement from the driver sub to the drill bit. That is, the drilling motion of the drill bit of the down the hole drilling assembly is defined by the combination of percussive force transferred to the drill bit by the reciprocating motion of the percussive mechanism and rotational force transferred to the drill bit by the rotating drilling assembly via the engagement of the shank splines and driver sub splines. The engagement of the shank splines and the driver sub splines therefore provides efficient transfer of rotational movement from the driver sub to the drill bit. It will be appreciated that engagement of the shank splines and the driver sub splines allows movement of the drill bit relative to the driver sub along the longitudinal axis of the down the hole drilling assembly, hence movably fixating the drill bit to the driver sub. It will further be appreciated that the engagement of the shank splines and driver sub splines form a spline area which may be configured to be part of the sealed volume positioned above the sealing element in the flow direction, therefore benefiting from the sealing effect of the sealing element.

The down the hole drilling assembly according to the present disclosure may be used with drill bits having various characteristics and parameters depending, for example, on the type of material being drilled. To this end, and according to a second aspect of the present disclosure, there is provided a drill bit for use in a down the hole drilling assembly according to the first aspect wherein the drill bit comprises an elongated shank and a drilling end, at least one flushing channel formed in the drill bit, wherein the at least one flushing channel comprises an inlet port, arranged at the shank of the drill bit, and an outlet port arranged at the drilling end. The drill bit of the second aspect further comprises a sealing element arranged on an outer surface of the shank and extending radially from the outer surface of the shank, wherein the inlet port of the at least one flushing channel is positioned between the sealing element and the drilling end.

Further objectives of, features of, and advantages with the present disclosure will become apparent when studying the following detailed description, the drawings, and the appended claims. Those skilled in the art will realize that different features of the present disclosure can be combined to create embodiments other than those described in the following.

BRIEF DESCRIPTION OF DRAWINGS

One or more embodiments will be described, by way of example only, and with reference to the following figures, in which.

DETAILED DESCRIPTION

The present disclosure is described in the following by way of a number of illustrative examples. It will be appreciated that these examples are provided for illustration and explanation only and are not intended to be limiting on the scope of the disclosure.

Furthermore, although the examples may be presented in the form of individual embodiments, it will be recognized that the present disclosure also covers combinations of the embodiments described herein.

Figure 1A:
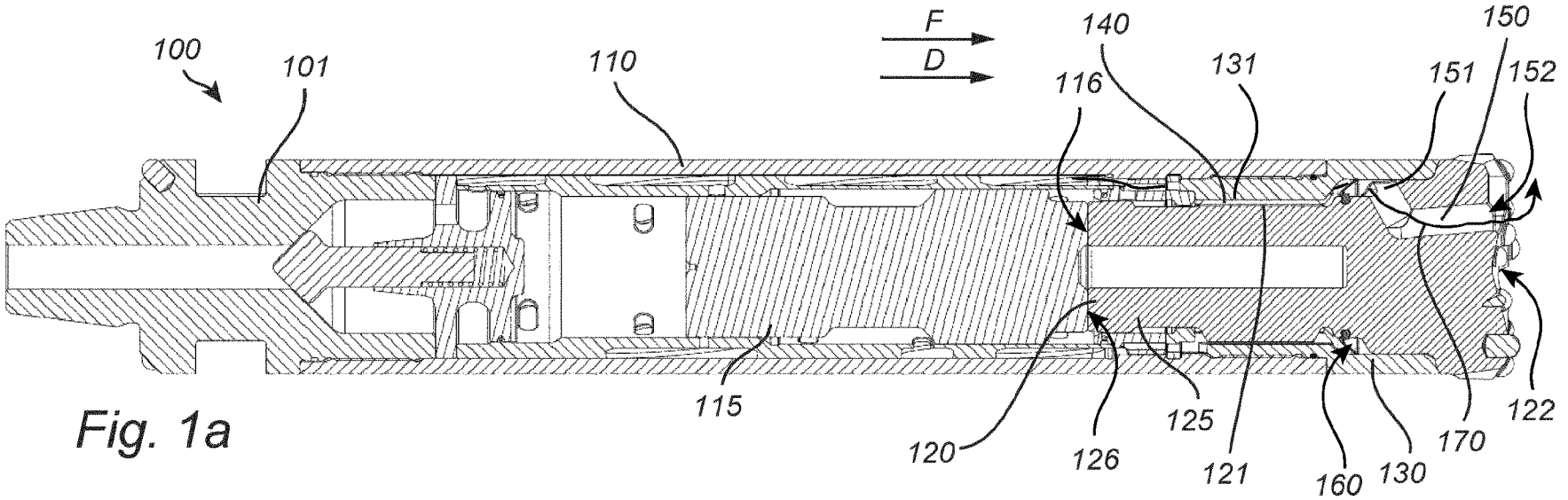
FIG. 1*a* schematically illustrates a cross-sectional view of a down the hole drilling assembly according to some embodiments of the present disclosure.

FIG. 1*a* schematically illustrates a cross-sectional view of a down the hole drilling assembly 100 according to some embodiments of the present disclosure. It will be appreciated that the cross-sectional view of FIG. 1*a* is a longitudinal cross-section along the drilling direction D of the down the hole drilling assembly 100. FIG. 1*a* shows the down the hole drilling assembly 100 comprising a top sub 101 configured to couple the drilling assembly 100 to a drill string (not shown) and a drill bit 120 arranged opposite the top sub 101. The drilling assembly 100 further comprises a percussive mechanism 115, or piston 115, configured to reciprocate within a piston casing 110 to provide a striking force on a working end 126 of the drill bit 120. Moreover, the drill bit 120 is shown comprising an elongated shank 125 and a drilling end 122 arranged to face the bottom of the drilling hole (not shown). FIG. 1*a* further depicts the drilling assembly 100 comprising a driver sub 130 at least partially arranged around the drill bit 120. FIG. 1*a* further shows the down the hole drilling assembly 100 in the drilling position. That is, the position of the drill bit 120 relative to the driver sub 130 is such that a striking surface 116 of the percussive mechanism 115 may repeatedly impact, or strike, the working end 126 of the drill bit 120, transferring the impact force to the drilling end 122. The down the hole drilling assembly 100 is further shown comprising a flushing passage 140 defined by an outer surface 121 of the shank 125 and an inner surface 131 of the driver sub 130. Furthermore, FIG. 1*a* shows a flushing channel 150 formed in the drill bit 120 wherein the flushing channel 150 comprises an inlet port 151, fluidly connecting the flushing passage 140 and the flushing channel 150, and an outlet port 152 arranged at the drilling end 122. The flushing passage 140 and the flushing channel 150 therefore form a continuous passageway configured to allow a flow of fluid 170 to flow in a flow direction F from the flushing passage 140 into the flushing channel 150 via the inlet port 151 and out of the drilling assembly 100 via the outlet port 152. FIG. 1*a* further illustrates a sealing element 160 arranged in the flushing passage 140 and extending radially from the outer surface 121 of the shank 125. The sealing element 160 is further shown positioned above the inlet port 151 in the flow direction F of the fluid flow 170, i.e., the sealing element 160 is positioned upstream of the inlet port 151. That is, the sealing element 160 is arranged proximate to the fluid connection between the flushing passage 140 and the flushing channel 150. Furthermore, the sealing element 160 of FIG. 1 a is shown fixedly attached to the shank 125 of the drill bit 120 by means of an interlocking structure, which will be defined clearly in later Figures. It will be appreciated that the sealing element 160 of FIG. 1*a* is configured to prevent a flow of fluid in a direction opposite to the flow direction F. That is, the sealing element 160 prevents from passing from flowing from the flushing channel 150 into the flushing passage 140. In other words, the sealing element 160 is a one way or one directional sealing element 160 that allows flow in one direction and prevents flow in the opposite direction.

Figure 1B:
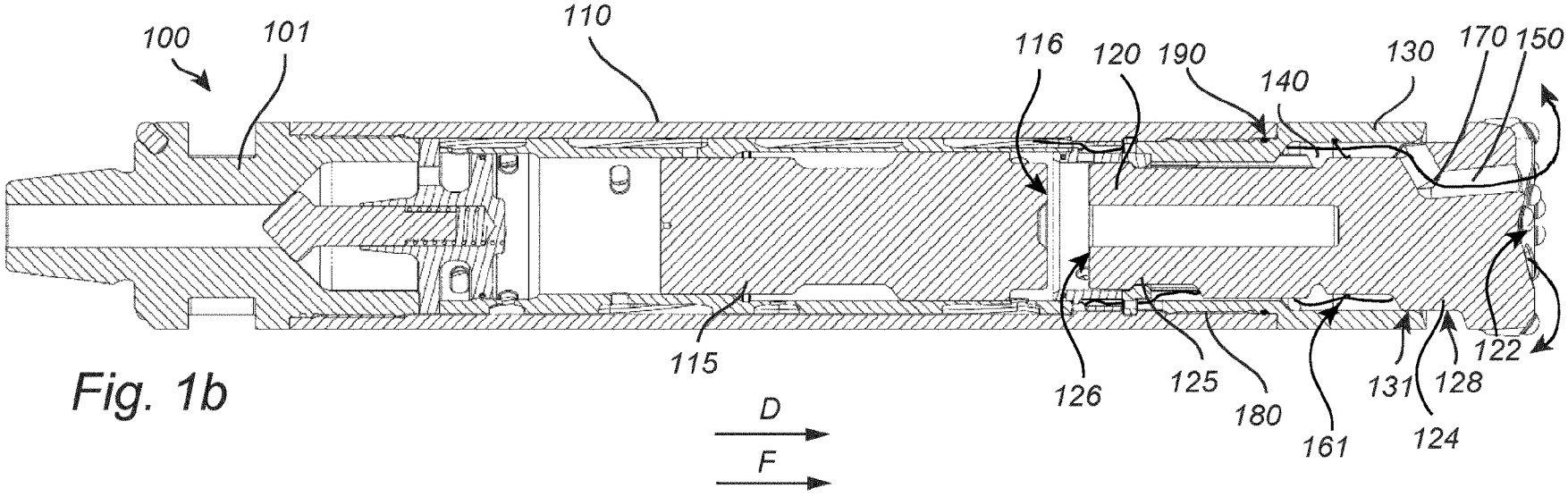
FIG. 1*b* schematically illustrates a cross-sectional view of the down the hole drilling assembly according to some embodiments of the present disclosure.

FIG. 1*b* schematically illustrates a similar cross-sectional view of the down the hole drilling assembly 100 as shown in FIG. 1*a*, with the down the hole drilling assembly 100 being in a flushing position. That is, the position of the drill bit 120 relative to the driver sub 130 is such that the repeated striking or impacting of the working end 126 of the drill bit 120 opposite its drilling end 122 is stopped. FIG. 1*b* therefore illustrates the drill bit 120 positioned relative to the driver sub 130 such that the reciprocating motion of the percussive mechanism 115 is stopped and therefore the striking motion of the drill bit 120 towards the bottom of the drill hole is stopped. FIG. 1*b* further illustrates an alternative configuration of the sealing element 161 shown fixedly attached to the driver sub 130 of the drilling assembly 100 by means of an interlocking structure, which will be defined clearly in later Figures. The sealing element 161 is shown extending radially from the driver sub 130 to the shank 125 in the fluid passage 140. The sealing element 161 is therefore shown configured to prevent a flow of fluid in a direction opposite to the flow direction F. FIG. 1*b* further illustrates the shank 125 of the drill bit 120 comprising an end portion 124 arranged adjacently to the drilling end 122 of the drill bit 120. The end portion 124 of the shank 125 is further shown comprising an outer surface 128 configured to be in contact with the inner surface 131 of the driver sub 130. That is, the outer surface 128 along the end portion 124 of the shank 125 is configured to axially guide the drill bit 120 relative to the driver sub 130 during movement of the drill bit 120 between the drilling position shown in FIG. 1*a* and the flushing position shown in FIG. 1*b*. FIG. 1*b* further illustrates the driver sub 130 interconnected to the piston casing 110 by means of corresponding threading 180 arranged on the outer surface of the driver sub 130 and on an inner surface of the piston casing 110. The down the hole drilling assembly shown in FIG. 1*b* further comprises a sealing ring 190 configured to prevent fluid and drilling debris from entering the piston casing 110 at the interconnection between the driver sub 130 and the piston casing 110.

Figure 2A:
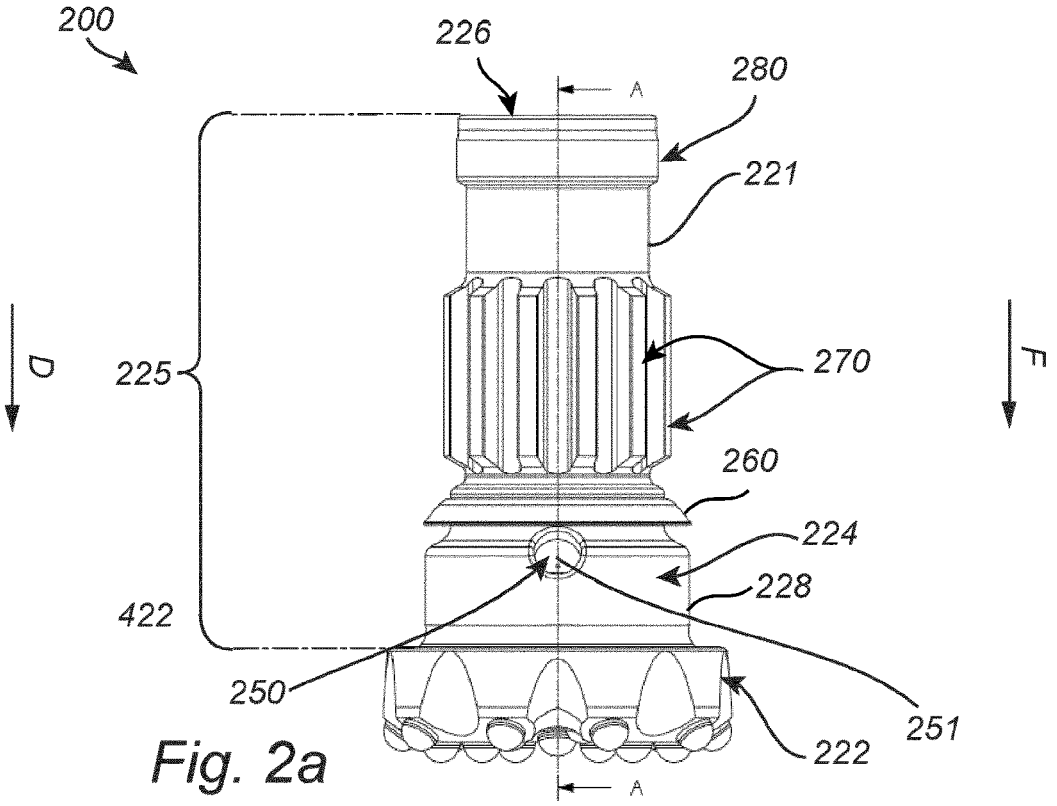
FIG. 2*a* schematically illustrates a projected view of a drill bit for use in a down the hole drilling assembly according to some embodiments of the present disclosure.
Figure 2B:
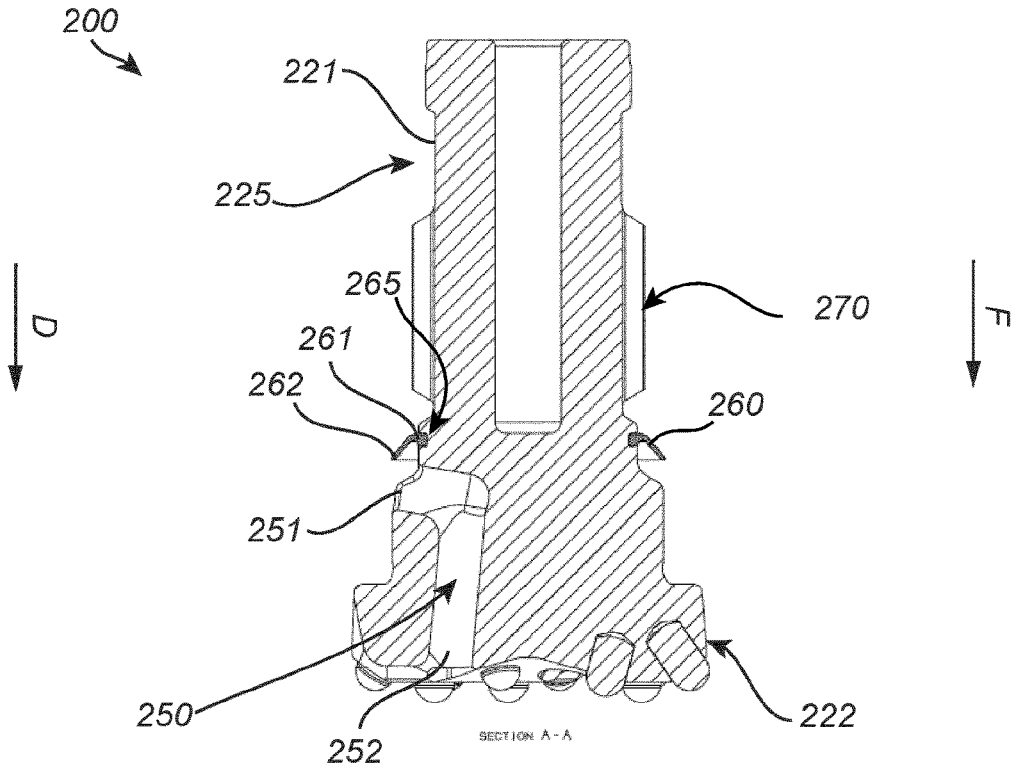
FIG. 2*b* schematically illustrates a cross-sectional view of the drill bit according to some embodiments of the present disclosure.

FIG. 2*a* schematically illustrates a projected view of a drill bit 200 for use in a down the hole drilling assembly according to some embodiments of the present disclosure. More particularly, FIG. 2*a* illustrates the drill bit 200 shown in the drilling assembly of FIGS. 1*a* and 1*b*. FIG. 2*a* illustrates the drill bit 200 comprising a working surface 226 configured to be impacted by the percussive mechanism of the drilling assembly and configured to transfer this percussive force to the drilling end 222. The drill bit 200 is further shown comprising an elongated shank 225, elongating from the working end 226 to the drilling end 222 in the drilling direction D, on an outer surface 221 of which are arranged a plurality of shank splines 270. The shank splines 270 are configured to engage driver sub splines (not shown) such that the drill bit 200 is movably fixated to the driver sub. It will be appreciated that the engagement between the shank splines 270 and the driver sub splines enable the transfer of rotational movement and torque from the drilling assembly to the drill bit 200. FIG. 2*a* further illustrates a flushing channel 250 formed in the drill bit 200 and comprising an inlet port 251 arranged on the shank 225 of the drill bit 200. It will be appreciated that the flushing channel 250 is configured to allow flushing fluid to exit the drilling assembly in which the drill bit 200 is to be used. The drill bit 200 is further shown comprising a sealing element 260 arranged on the outer surface 221 of the shank 225 and extending radially from the outer surface 221. The sealing element 260 is further shown positioned above the inlet port 251 of the flushing channel 250 in the direction F of the flow and below the shank splines 270 in the same direction F. In different words, the sealing element 260 is arranged on the shank 225 of the drill bit 200 between the shank splines 270 and the inlet port 251 of the flushing channel 250. The shank splines 270 of the drill bit 200 are therefore configured to be comprised in the sealed volume provided by the sealing element 260 when the drill bit 200 is, for example, used in the down the hole drilling assembly 100 illustrated in FIGS. 1*a* and 1*b*. FIG. 2*b* further illustrates a retention shoulder 280 comprised on the shank 225 and positioned directly adjacent to the working end 226 of the drill bit 200. The retention shoulder 280 is configured to limit the axial movement of the drill bit 200 relative to the driver sub in the drilling direction D, when used in a drilling assembly. Additionally, the shank 225 of the drill bit 200 comprises an end portion 224 arranged adjacently to the drilling end 222 wherein the end portion 224 comprises an outer surface 228. It will be appreciated that the drill bit 200 of FIG. 2*a*, or any drill bit according to the present disclosure, may embody a modular configuration. That is, the drill bit 200 may be assembled from interchangeable parts.

For example, the drilling end 222 may be removably attached, e.g. screwed, to the shank 225 such that different drilling ends may be used with a specific shank. This modular configuration of the drill bit according to the present disclosure enables the down the hole drilling assembly to be suitable for a greater variety of applications and types of drilled material.

FIG. 2*b* schematically illustrates a cross-sectional view of the drill bit 200 according to some embodiments of the present disclosure. It will be appreciated that the cross-section of the drill bit 200 is taken along the longitudinal axis A illustrated in FIG. 2*a*. FIG. 2*b* provides a clearer view of the flushing channel 250 formed in the drill bit 200 and its inlet port 251 and outlet port 252. Furthermore, FIG. 2*b* illustrates the sealing element 260 fixedly attached to the shank 225 of the drill bit 200 by means of an interlocking structure. The interlocking structure being a tongue and groove structure formed by a first end 261 of the sealing element 260 engaging a groove 265 comprised in the outer surface 221 of the shank 225. The sealing element 260 of FIG. 2*b* further comprises a second end 262 configured to contact the inner surface of the driver sub when the drill bit 200 is used in a down the hole drilling assembly. It will be appreciated that the sealing element 260 is angled towards the shank 225 of the drill bit 200 in the drilling direction D. That is, the shape of the sealing element 260 is such that it is configured to form acute angle with the outer surface 221 of the shank 225. The shape of the sealing element 260 permits it to allow a flow of fluid in the flow direction F and prevent a flow of fluid in a direction opposite to the flow direction F.

Figure 3:
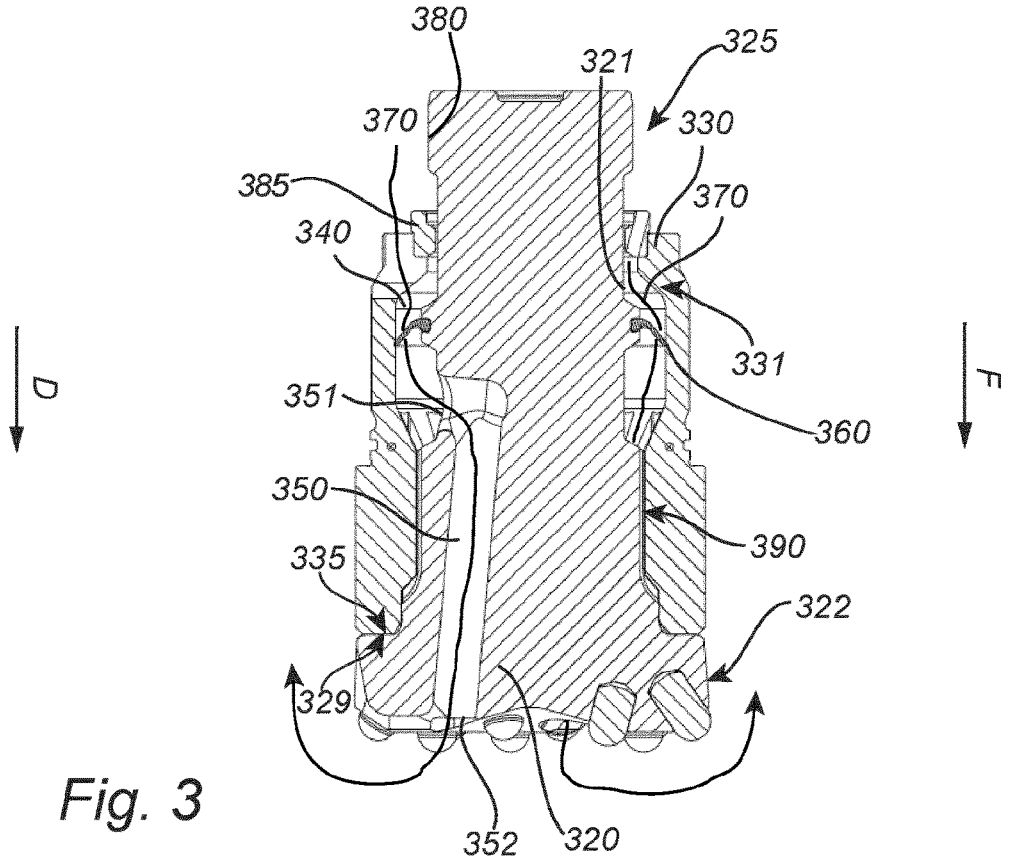
FIG. 3 schematically illustrates a cross-sectional view of a driver sub and a drill bit of a down the hole drilling assembly according of some embodiments of the present disclosure.

FIG. 3 schematically illustrates a cross-sectional view of a driver sub 330 and a drill bit 320 of a down the hole drilling assembly according to some embodiments of the present disclosure. It will be appreciated that FIG. 3 illustrates the driver sub 330 and the drill bit 320 as assembled in a down the hole drilling assembly according to the present disclosure. FIG. 3 illustrates the driver sub 330 at least partially arranged around the drill bit 320, a flushing passage 340 defined by the outer surface 321 of the shank 325 of the drill bit 320 and the inner surface 331 of the driver sub 330. FIG. 3 further illustrates a first flushing channel 350 and a second flushing channel (not visible in FIG. 3) formed in the drill bit 320. The first flushing channel 350 is further shown comprising an inlet port 351 fluidly connecting the flushing passage 340 and the flushing channel 350 and an outlet port 352 arranged at the drilling end 322 of the drill bit 320. It will be appreciated that the second flushing channel is characterized similarly as the first flushing channel 350. FIG. 3 further illustrates a sealing element 360 arranged in the flushing passage 340 and extending radially from its fixed attachment to the outer surface 321 of the shank 325 to the inner surface 331 of the driver sub 330. The sealing element 360 is further shown positioned above the inlet port 351 of the first flushing channel 350 in the direction F of the flow of fluid 370. It will be appreciated that the sealing element 360 is also positioned above the inlet port of the second flushing channel (not visible in FIG. 3). FIG. 3 therefore depicts the sealing element 360 configured to allow the flow of fluid 370 to travel in the flow direction F i.e. from the flushing passage 340 into the first flushing channel 350 and second flushing channel and out of the drill bit 320 via the outlet port 352 of the first flushing channel 350 and via the outlet port of the second flushing channel. The sealing element 360 is further shown configured to prevent any flow of fluid to travel from the flushing channels 350 into the fluid passage 340 in a direction opposite to the flow direction F. It will be appreciated that sealing element 360 is also positioned above the spline area 390, formed by the engagement of the shank splines arranged on the outer surface 321 of the shank 325 with the driver sub splines arranged on the inner surface 331 of the driver sub 330, in the flow direction F. further illustrates the drill bit 320 comprising a retention shoulder 380 at its working end opposite its drilling end 322. The retention shoulder 380 is configured to limit the axial movement of the drill bit 320 relative to the driver sub 330 in the drilling direction D by abutting a retention ring 385 coupled to the driver sub 330. In the direction opposite to the drilling direction D, the axial movement of the drill bit 320 relative to the driver sub 330 is limited by the abutment of an inner surface 329 of the drilling end 322 against an end surface 335 of the driver sub 330. The interaction between the retention shoulder 380 and the retention ring 385 and the interaction between the inner surface 329 of the drilling end 322 and the end surface 335 of the driver sub 330 therefore ensure that the drill bit 320 remains movably connected to the drilling assembly during operation.

Figure 4:
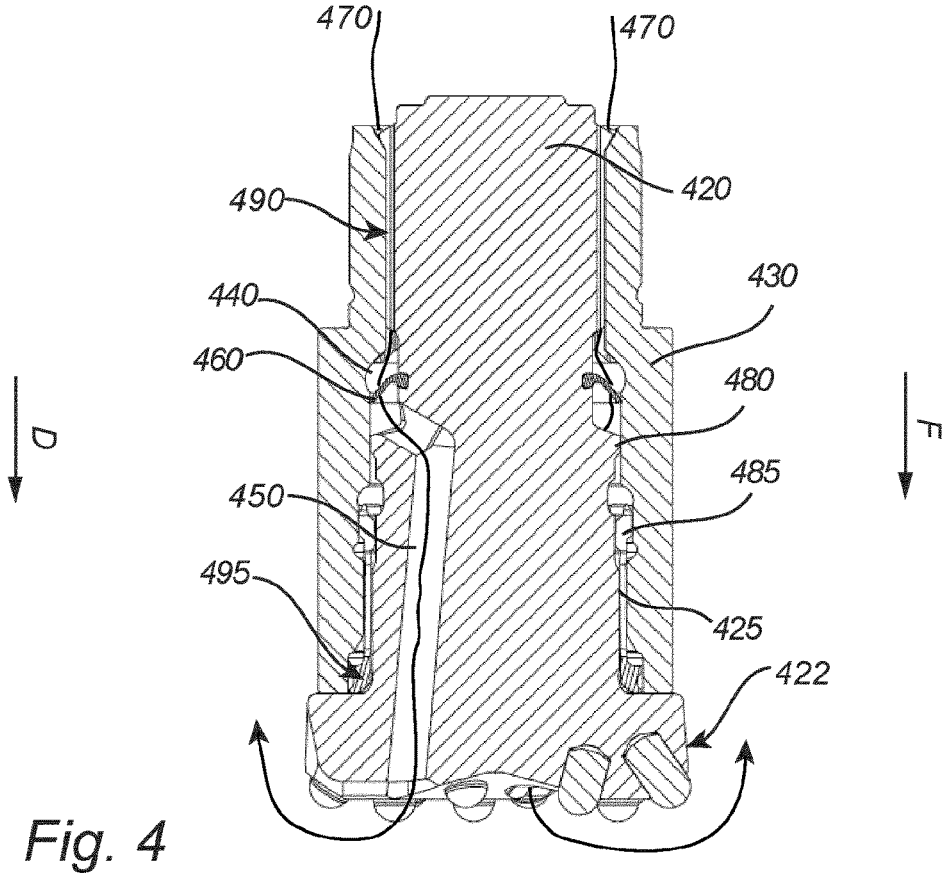
FIG. 4 schematically illustrates a cross-sectional view of a driver sub and a drill bit of a down the hole drilling assembly according of some embodiments of the present disclosure.

FIG. 4 schematically illustrates a cross-sectional view of a driver sub 430 and a drill bit 420 of a down the hole drilling assembly according to some embodiments of the present disclosure. It will be appreciated that FIG. 4 illustrates an alternative configuration to the driver sub 330 and drill bit 320 shown in FIG. 3 differing from the configuration of FIG. 3 in that the spline area 490 is positioned above the sealing element 460 in the flow direction F. That is, the spline area 490 of FIG. 4 benefits from the sealing effect of the sealing element 460. Furthermore, FIG. 4 shows the sealing element 460 positioned above the retention ring 485 and the retention shoulder 480 in the flow direction F. Still further, FIG. 4 depicts a radial seal 495 arranged around the shank 425 of the drill bit 420 and positioned adjacently above to the drilling end 422 of the drill bit 420 in the drilling direction D.

The radial seal 495 may be configured to prevent fluid and drilling debris from entering the drilling assembly thus reducing the risk of internal wear of the driver sub 430 and drill bit 420. As the assembly of the driver sub 430 and drill bit 420 of FIG. 4 illustrates an alternative configuration to the configuration shown in FIG. 3, it will be appreciated that the sealing element 460, the flushing passage 440 and the flushing channel 450 through which the flow 470 travels in the flow direction F may be characterized similarly as the sealing element 360, the flushing passage 340 and the flushing channel 350 of FIG. 3.

Figure 5:
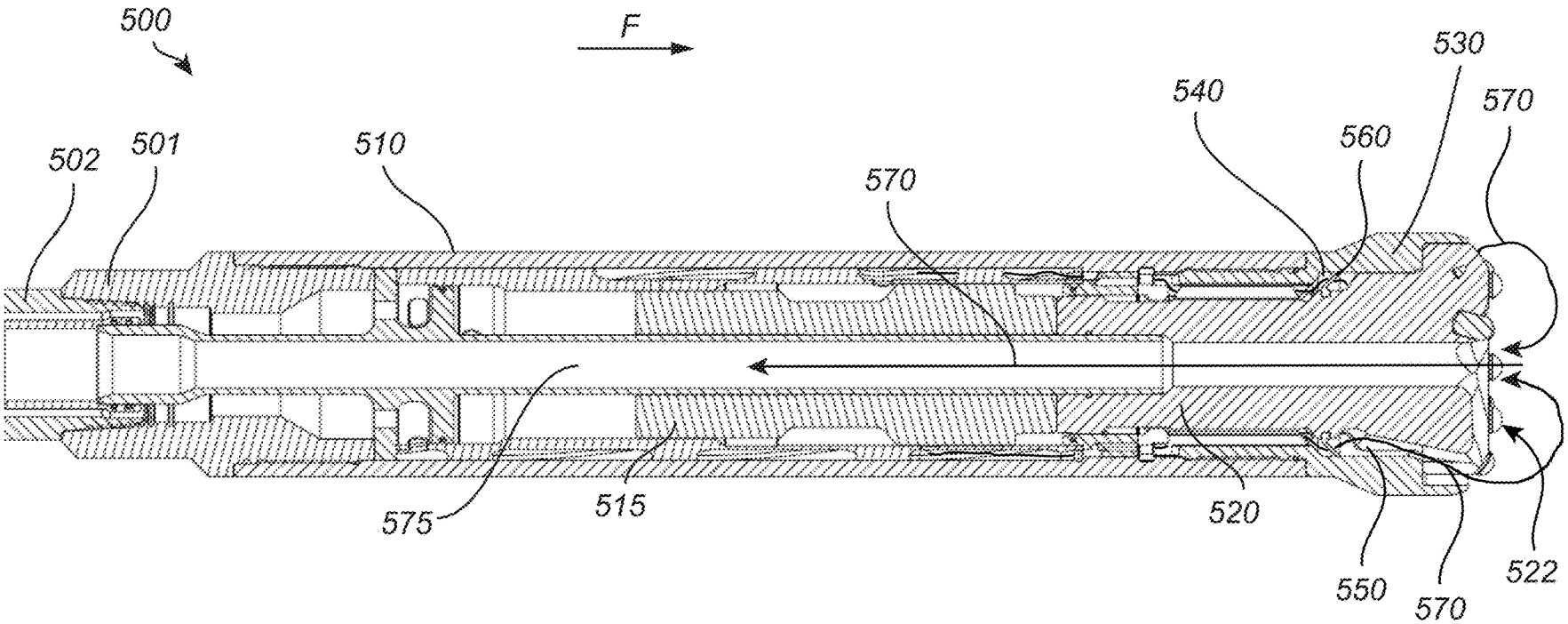
FIG. 5 schematically illustrates a cross-sectional view of a down the hole drilling assembly according to some embodiments of the present disclosure.

FIG. 5 schematically illustrates a cross-sectional view of a down the hole drilling assembly 500 according to some embodiments of the present disclosure. It will be appreciated that the cross-sectional view of FIG. 5 is a longitudinal cross-section along the drilling direction D of the down the hole drilling assembly 500. It will further be appreciated that the drilling assembly 500 is adapted for reverse circulation drilling, or RC drilling, for which the drilling cuts, chips, fines, residues, contaminants, etc. are removed from the drill hole via a central bore 575 arranged in the center of the drilling assembly 500. FIG. 5 illustrates the drilling assembly 500 in the drilling position, comprising a top sub 501 configured to couple the drilling assembly 500 to a drill string 502 and a drill bit 520 arranged at the opposite end of the top sub 501. The drilling assembly 500 further comprises a percussive mechanism 515, or piston 515, configured to reciprocate within a piston casing 510 to provide a striking force on a working end of the drill bit 520. The drilling assembly 500 shown is FIG. 5 further comprises a flushing passage 540, at least one flushing channel 550 and a sealing element 560 arranged in the flushing passage 540. The flushing passage 540 and the flushing channel 550 are therefore configured to allow a flow of fluid 570 to pass therethrough in a flow direction F of the fluid and the sealing element 560 is configured to prevent a flow of fluid from entering the drilling assembly 500 and passing from the flushing channel 550 to the flushing passage 540 in a direction opposite to the flow direction F. FIG. 5 further illustrates the central bore 575 comprised in the center of the down the hole drilling assembly 500. The central bore 570 is shown extending from the top end 501 of the drilling assembly 500 to the drilling end 522 of the drill bit 520. That is, the central bore 575 is configured to provide a fluid passage through each component of the drilling assembly 500, allowing reverse circulation drilling, i.e. allowing drilling cuts, chips, fines, residues, contaminants, etc. to be transported to the surface, or top of the drilling hole, via the central bore 575 during the flushing action of the drilling assembly 500.

It will be appreciated that, although the above aspects are presented separately, they may be combined in any suitable manner such that a casing may benefit from all of the advantages provided by respective aspects of the present disclosure.

Furthermore, whilst the forgoing description and the appended drawings are provided as exemplary or preferred realizations of the disclosed aspects, it will be appreciated that the disclosed aspects need not be limited to the exact form shown and/or described.

The invention claimed is:

1. A down the hole drilling assembly comprising:

a drill bit having an elongated shank and a drilling end;

a driver sub at least partially arranged around the drill bit;

a flushing passage defined by an outer surface of the shank and an inner surface of the driver sub;

at least one flushing channel formed in the drill bit, wherein the at least one flushing channel includes an inlet port fluidly connecting the flushing passage and the at least one flushing channel and an outlet port arranged at the drilling end; and a sealing element arranged in the flushing passage and extending radially from the outer surface of the shank to the inner surface of the driver sub, wherein the flushing passage and the at least one flushing channel are configured to allow a flow of fluid from the flushing passage to the at least one flushing channel in a flow direction (F) of the fluid, wherein the sealing element is positioned above the inlet port of the at least one flushing channel along the flow direction; and wherein the sealing element is configured to be forced to deform to an open configuration by fluid flowing in the flow direction thereby allowing fluid flow in the flow direction and to subsequently close to prevent a flow of fluid in a direction opposite to the flow direction.

2. The drilling assembly according to claim 1, wherein the sealing element is fixedly attached to the shank of the drill bit by an interlocking structure.

3. The drilling assembly according to claim 2, wherein the interlocking structure is a tongue and groove structure formed by an end of the sealing element configured to engage a groove included in the outer surface of the shank.

4. The drilling assembly according to claim 1, wherein the sealing element is fixedly attached to the driver sub by an interlocking structure.

5. The drilling assembly according to claim 4, wherein the interlocking structure is a tongue and groove structure formed by an end of the sealing element configured to engage a groove included in the inner surface of the driver sub.

6. The drilling assembly according to claim 1, wherein the sealing element is formed of an at least partially elastomer material.

7. The drilling assembly according to claim 1, further comprising a piston casing configured to interconnect with the driver sub by means of a corresponding threading included on an inner surface of the piston casing and on an outer surface of the driver sub.

8. The drilling assembly according to claim 7, further comprising a sealing ring arranged between the inner surface of the piston casing and the outer surface of the driver sub, wherein the sealing ring is configured to prevent fluid from entering the piston casing.

9. The drilling assembly according to claim 1, wherein the drill bit is configured to move axially relative to the driver sub between a drilling position and a flushing position.

10. The drilling assembly according to claims 9, wherein the shank further comprises an end portion arranged adjacently to the drilling end and wherein the outer surface of the shank along the end portion is configured to be in contact with the inner surface of the driver sub.

11. The drilling assembly according to claim 10, wherein the end portion of the shank is configured to axially guide the drill bit relative to the driver sub during movement of the drill bit between the drilling position and the flushing position.

12. The drilling assembly according to claim 1, wherein the driver sub is provided with a plurality of driver sub splines arranged on the inner surface.

13. The drilling assembly according to claim 12, wherein the shank of the drill bit is provided with a plurality of shank splines arranged on the outer surface thereof.

14. The drilling assembly according to claim 13, wherein the shank splines are configured to engage with the driver sub splines, moveably fixating the drill bit to the driver sub.

* * * * *